US008171598B1

(12) United States Patent
Hiltz

(10) Patent No.: US 8,171,598 B1
(45) **Date of Patent: *May 8, 2012**

(54) DUAL PORT CLEANING AND EXTRACTION APPARATUS

(76) Inventor: Erik Daniel Hiltz, Brownstown Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/843,621

(22) Filed: Jul. 26, 2010

(51) Int. Cl.
*A47L 7/00* (2006.01)

(52) U.S. Cl. ..... 15/322; 15/320; 15/415.1; 15/418; 15/420; 15/422

(58) Field of Classification Search ..... 15/320, 15/322, 415.1, 418, 420, 422; *A47L 7/00*
See application file for complete search history.

(56) References Cited

U.S. PATENT DOCUMENTS

| | | | |
|---|---|---|---|
| 4,069,541 | A | 1/1978 | Williams |
| 4,137,600 | A | 2/1979 | Albishausen |
| 4,164,055 | A | 8/1979 | Townsend |
| 4,333,203 | A | 6/1982 | Yonkers |
| 4,485,518 | A | 12/1984 | Kasper |
| 5,075,921 | A | 12/1991 | Gleadall |
| 5,113,547 | A | 5/1992 | Mayhew |
| 5,157,805 | A | 10/1992 | Pinter |
| 5,180,439 | A | 1/1993 | Allison |
| 5,485,652 | A | 1/1996 | Holland |
| 5,555,598 | A | 9/1996 | Grave |
| 5,752,289 | A | 5/1998 | Collins |
| 5,891,198 | A | 4/1999 | Pearlstein |
| 6,055,699 | A | 5/2000 | Cho |
| 6,152,151 | A | 11/2000 | Bolden |
| 6,263,539 | B1 | 7/2001 | Baig |
| 6,453,506 | B1 | 9/2002 | Sumner |
| 6,598,262 | B2 | 7/2003 | Farina |
| 6,852,858 | B2 | 2/2005 | Feher et al. |

*Primary Examiner* — David Redding
(74) *Attorney, Agent, or Firm* — Carrier Blackman & Associates, P.C.; Joseph P. Carrier; William D. Blackman

(57) ABSTRACT

An apparatus for cleaning and extracting water from carpet, comprising a vacuum head including a vacuum chamber configured to be connected to a vacuum source and two downward facing elongate vacuum ports extending downwardly from the vacuum chamber and an elongate solution manifold mounted between the vacuum ports and configured to discharge cleaning liquid in a space between the vacuum ports. The vacuum ports are configured to extract waste liquid from carpet when the vacuum head is moved in both a forward motion and a backward motion of the vacuum head. Further, the vacuum head includes elongate glides sealingly fitted in lower openings of the vacuum ports, the glides having suction openings formed therein through which fluids may be drawing into the vacuum ports, and the glides project below the bottom face of the vacuum head.

4 Claims, 9 Drawing Sheets

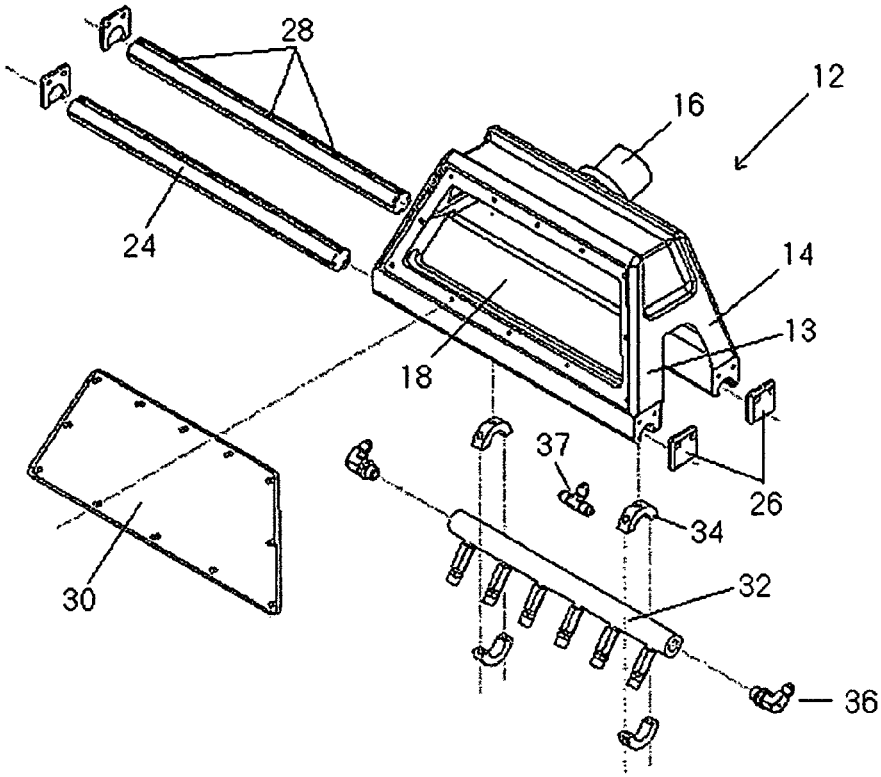
FIGURE
4
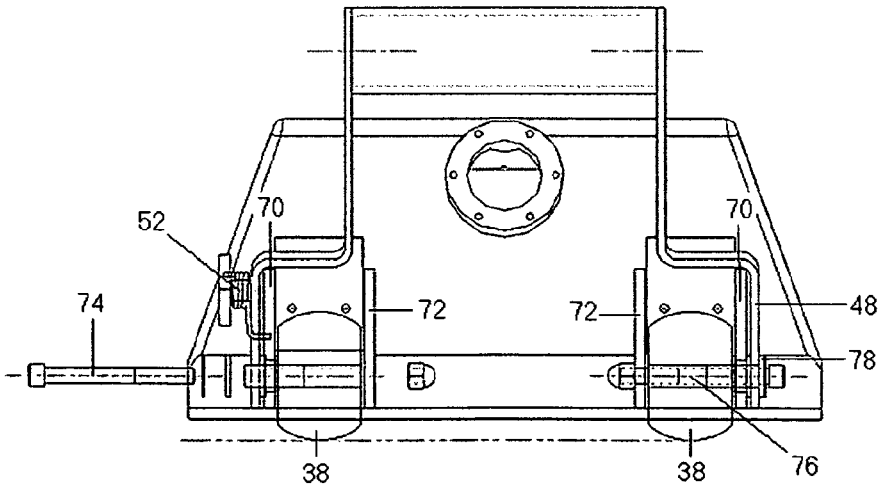
Figure 5

DUAL PORT CLEANING AND EXTRACTION APPARATUS

CROSS-REFERENCE TO RELATED APPLICATIONS

The present invention claims priority under 35 USC §119 based on U.S. patent application Ser. No. 12/231,408, filed 2 Sep. 2008 (now U.S. Pat. No. 7,761,955), which claims priority from U.S. provisional patent application 60/966,913, filed 30 Aug. 2007. The subject matter of this priority document, including specification, claims and drawings, is incorporated by reference herein.

BACKGROUND OF THE INVENTION

Wands typically consist of a long tubular pipe with one vacuum head having a vacuum port and a spray manifold or nozzle attached thereto.

The problem with a traditional wand lies in the design. Wands generally consist of one vacuum port which can only clean on a backwards motion. Consequently, the wand is moving in both directions, but only cleaning on the backwards movement. This causes a lot of wasted energy and fatigue.

The cleaning of large areas of carpeting is a time consuming and strenuous task. The extensive effort which is needed in order to push and pull the wand across the carpet can quickly fatigue a person using a traditional wand. In a commercial carpet cleaning operation, where large areas of carpeting are cleaned daily, fatigue will significantly place a limit on production rate.

Commercial carpet cleaning machines typically generate tremendous vacuum pressure which is then applied to the carpet through the wand. The vacuum pressure often causes the traditional wand to dig into the carpet, raising the inches of lift. Therefore, deadening the air-flow causing static lift. This causes the forward movement of the wand to be very strenuous.

Typically, a wand is constructed of a solid pipe with a fixed handle during operation. This causes the operator to tilt his or her body to one side, while slightly lifting the wand with their lead hand. All of the force and weight while moving the traditional wand vertically is applied to your shoulder and lower back. This causes unnatural twisting and turning of the human body, resulting in excessive strain on the lower back and shoulder.

Even with the problems associated with traditional cleaning wands, the truck mounted cleaning machines are still considered the most effective means for extracting water and cleaning carpet. Consequently, there is a need to improve the design and use of the traditional cleaning wand.

Several advantages of one or more aspects is to provide a cleaning apparatus with one vacuum head with two inlet ports that moves with ease and cleans and extracts both forward and backward. Another advantage of one or more aspects is to provide a cleaning apparatus which alleviates some of the strains and stress inflicted on the human body while cleaning carpet. Furthermore, other advantages of one or more aspects is to provide a head design which allows for increased airflow and improved drying time. These and other advantages will be described in greater detail hereinafter. One or more features solve the abovementioned and utilizes a number of unique features that render it highly beneficial over prior art.

There are a number of patents disclosing various apparatuses which will accomplish, in general terms, some of the above-noted functions. The following patents are presented to aid in understanding and to some extent related to the current invention:

U.S. Pat. No. 4,069,541 to Williams, et al. (1978)
U.S. Pat. No. 4,137,600 to Albishausen (1979)
U.S. Pat. No. 4,333,203 to Yonkers (1982)
U.S. Pat. No. 4,485,518 to Kasper (1984)
U.S. Pat. No. 5,075,921 to Gleadall (1991)
U.S. Pat. No. 5,113,547 to Mayhew (1992)
U.S. Pat. No. 5,157,805 to Pinter (1992)
U.S. Pat. No. 5,180,439 to Allison (1993)
U.S. Pat. No. 5,485,652 to Holland (1996)
U.S. Pat. No. 5,555,598 to Grave, et al. (1996)
U.S. Pat. No. 5,752,289 to Collins (1998)
U.S. Pat. No. 5,891,198 to Pearlstein (1999)
U.S. Pat. No. 6,055,699 to Cho (2000)
U.S. Pat. No. 6,152,151 to Bolden, et al. (2000)
U.S. Pat. No. 6,263,539 to Baig (2001)
U.S. Pat. No. 6,453,506 to Sumner (2002)

SUMMARY OF THE INVENTION

In accordance with one embodiment, the present invention addresses the limitations of the aforementioned prior art by providing a method for cleaning and/or extracting liquids from carpets or like fabrics.

This cleaning apparatus, unlike prior art, has one vacuum head with two inlet ports parallel to one another. As will be described in further detail, these inlet ports are positioned so that both ports penetrate the carpet fibers at an even depth at all times during operation. This unique feature allows for balanced airflow in the vacuum head due to the operator having no control of lifting the front or back ports off the ground due to the handle having a non-fixed position during operation.

The open air space in the top portion of the vacuum head creates a dynamic lift and an inverse relationship between lift and airflow. This coupled with the glides greatly increases airflow for smoother operation and faster dry times.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4 is an exploded view of the vacuum head of the embodiment including a wheel assembly and a handle latching assembly.

FIG. 5 is a back view of handle brackets and wheel assembly.

DETAILED DESCRIPTION OF ILLUSTRATIVE EMBODIMENTS

Figure 1:
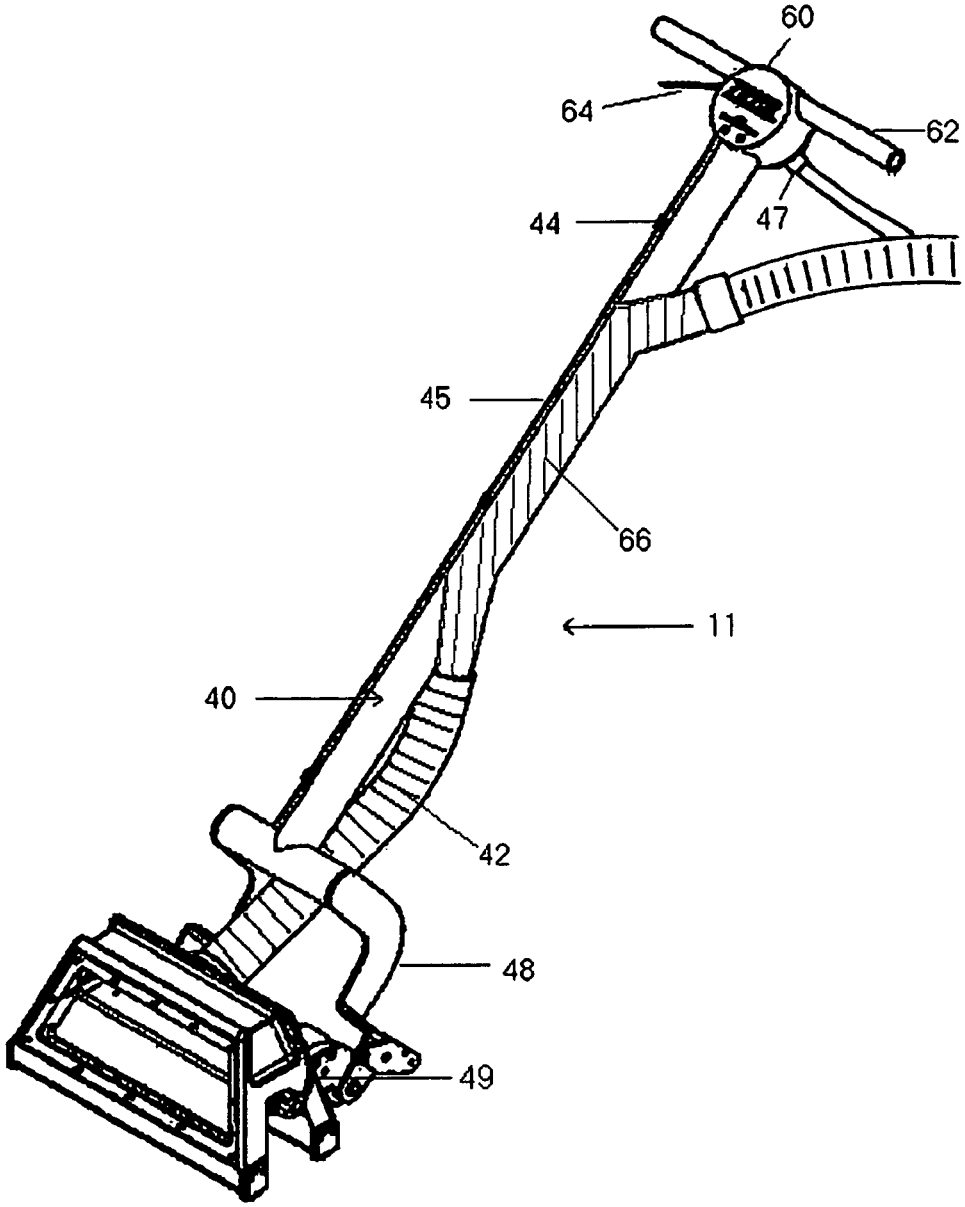
FIG. 1 is a perspective view of one exemplary embodiment of the present invention.

Referring to FIGS. 1, 2, 4, and 6. One embodiment of the apparatus 11 is preferably coupled to a truck mounted cleaning machine with 2 inch vacuum hose or a similar flexible conduit and ¼ inch or similar high pressure/high temperature solution line. The vacuum hose is coupled to a vacuum passageway 66 closest to valve 60. The high pressure/high temperature solution line is coupled to valve 60 using ¼ inch male and female quick connect couplers or similar hardware.

Valve 60 is designed to allow the cleaning solution to flow from solution inlet 47 to solution line 45 when solution lever 64 is depressed pulled toward handle bar 62. Solution lever 64 is coupled to valve 60 with a shoulder bolt and a roll pin to keep the lever in the correct position for operation.

Valve 60, unlike prior art, is formed from four inch bar stock using a machining process known as billet. Valve 60 is machined from a single piece of aluminum, but may also be fabricated by welding or otherwise securing just described components together.

When solution lever 64 is depressed, cleaning solution passes from solution inlet 47 through valve 60 out to solution line 45. Solution line 45 is coupled to solution tee 37 and solution line 45 is attached to handle arm 40 using solution line clip 44. Cleaning solution is then directed from solution tee 37, bi-directionally, to stainless steel, or like material, solution line 49. Solution line 49 is coupled to a ninety degree line fitting 36. Ninety degree line fitting 36 is coupled to solution manifold 32. Solution jets 69 are attached to solution manifold 32.

Solution manifold 32 is designed to allow for adjustment. In initial configuration, solution manifold 32 should be set so that solution jets 69 are directing cleaning solution spray about ¼ inch behind front vacuum port 13. Attached to solution manifold 32 are a plurality of check valves 68, e.g., six in the depicted embodiment. Each check valve is terminated by a solution jet 69. Solution manifold 32 is attached to vacuum head 12 with 2 manifold brackets 34. While the manifold 32 is used in the embodiment, it is possible to directly connect a solution line to one or more discharge nozzles or jets, and eliminate the manifold.

Figure 3:
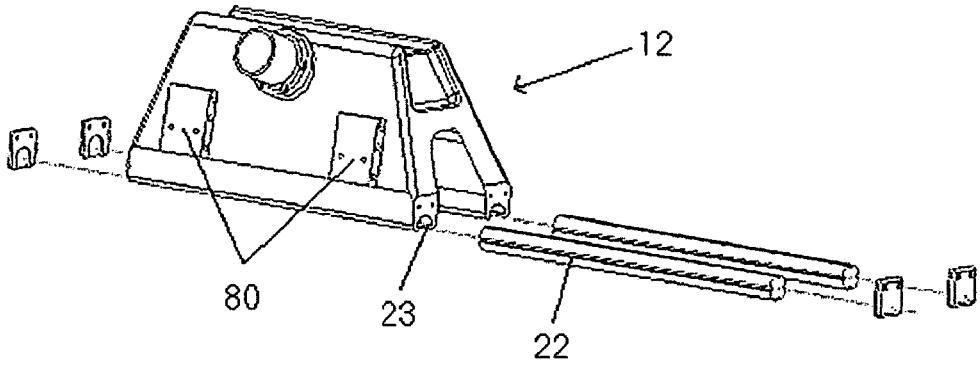
FIG. 3 is a back view of a vacuum head of the embodiment with the glides and glide retainers removed.
Figure 6:
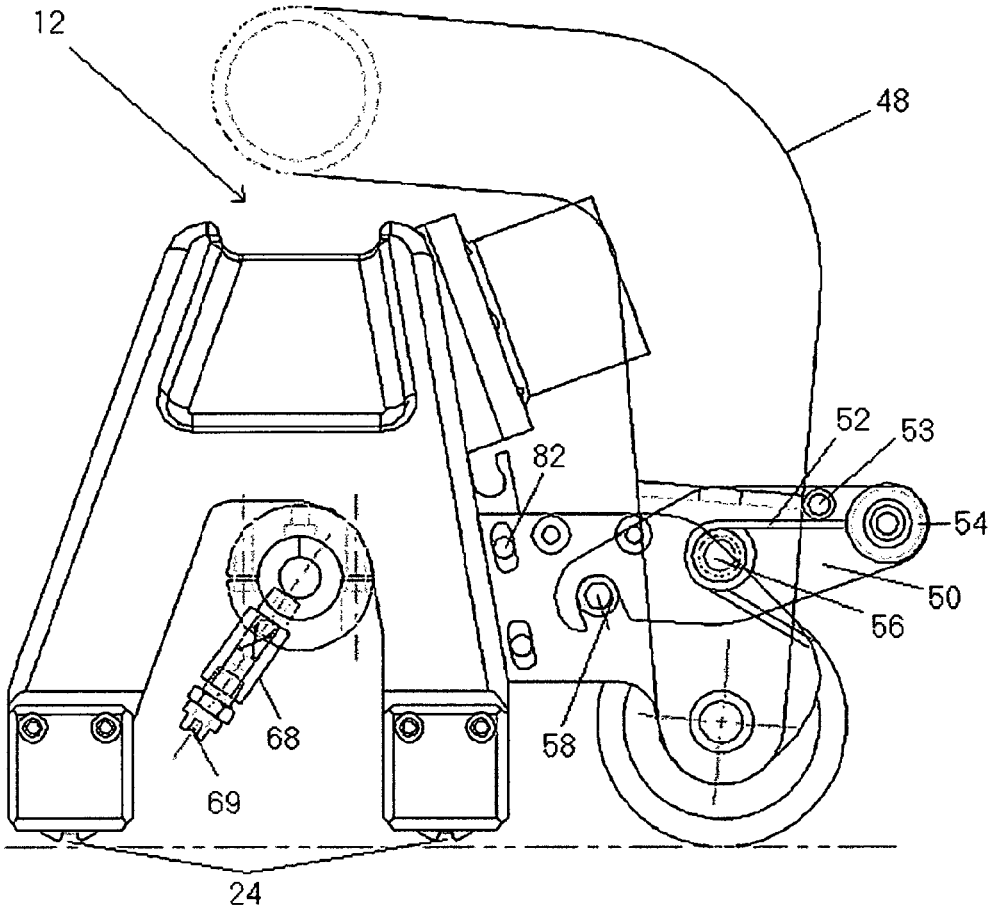
FIG. 6 is a side view of the complete vacuum head of the embodiment.

Referring to FIGS. 3 and 6. Vacuum head 12 is formed from a single block of aluminum using a machining process known as billet. Unlike prior art, vacuum head 12 is designed this way to accommodate the rounded design of our glides 24. Glides 24 are inserted into vacuum ports 13 and 14 along male glide channels 23 formed to project into opposite sides of each of the ports 13, 14 and female glide channels 22 formed into each glide on opposite sides thereof so as to slidingly receive the male glide channels 23. Using this method allows us to have a reversible glide that is round in design, such that opposite (upper or lower) sides of the glides may be selectively positioned to project from the lower face of the vacuum head, without having void areas in the chambers above glide channels 22 and 23. This feature doubles the life of the glides 24. The support bridges 28 are recessed far enough into glides 24 to allow for glides to wear down/out and not reach bridges 28 to break up the vacuum into separate chambers. This feature eliminates bridge lines in the carpet being cleaned. These glides are held in place, preventing lateral movement, using four glide retainers 26, which also serve as a bumper to prevent scratching of walls, baseboards, and other objects. Glides 24 are designed to allow for maximum air flow, stability of vacuum head 12, and to reduce friction on the cleaning surface.

While the glide structure shown in the drawings is particularly effective and advantageous, modifications are possible. For example, while a single elongate opening may be formed through the glide, with or without the supporting bridges, as discussed above, it is possible to form a plurality of separate/spaced openings through the glide, such as 10-50 openings. Further, the glide may have a cross sectional shape other than circular or substantially circular. For example, the lower projecting surface may be formed flat, rather than curved or arc-shaped. Still further, it is possible to form male channels projecting from the glide, and female channels recessed into the vacuum inlet ports of the vacuum head, rather than the opposite arrangement in the depicted structure.

Referring to FIGS. 1, 3, 5, and 6, the vacuum head may be provided with an adjustable wheeled support mechanism for facilitating movement of the head over carpet and other surfaces. To maintain the stability of vacuum head 12, convex wheels 38 can be adjusted relative to the vacuum head. Unlike prior art, wheels 38 are designed such that the entire apparatus can be moved laterally across the cleaning surface. Wheels 38 are connected to inside/outside brackets 70 and 72 using an axle bolt 74 inserted through bushing 76 which is inserted through wheel 38. Brackets 70 and 72 are connected to wheel bracket mounts 80 using retainers such as screws, bolts, or other such hardware.

To achieve the adjustment that is necessary for vacuum head stability, brackets 70 and 72 are designed in such a way that they can be adjusted using wheel bracket adjustment slots 82. These are oblong slots cut into brackets 70 and 72. The purpose of this adjustment is to ensure that the glides and wheels remain level at all times during operation, thereby assuring proper/maximum suction/extraction of liquids from carpet by the vacuum head.

Referring to FIGS. 1 and 5. Handle arm bracket 48 is connected to axles 74 through oil lite bushings 78. Unlike prior art, combined with a stable (dual port) vacuum head with adjustable wheels, this allows handle arm 40 to pivot in a non-fixed position during operation. The non-fixed handle arm allows the operator to maintain an erect posture during operation.

Referring to FIGS. 1 and 6. When handle arm 40 is fully upright, it may be locked into position. This is achieved when handle latch 50 is resting on latch pin 58. To release handle arm 40 for operation, pressure is applied downward on foot peg 54. This compresses torsion spring 52 which is attached to shoulder bolt 56. Shoulder bolt 56 is connected to handle bracket 48. Handle bracket 48 is welded to handle arm 40. This process lifts handle latch 50 off of latch pin 58, releasing the handle arm. To keep torsion spring 52 from depressing and to keep handle latch 50 in proper position, latch stopper 53 is used to keep tension on torsion spring 52.

Referring to FIG. 6. When in operation, on a forward movement, waste water is extracted from carpet through glide 24 channeled through back vacuum port 14 and into inside vacuum chamber 18. On a backward movement, waste water is extracted from carpet through glide 24 channeled through front vacuum port 13 and into inside vacuum chamber 18. Vacuum chamber cover 30 is attached to vacuum head 12. In this use, chamber cover 30 is made from lexan but can be made from any material which would seal the vacuum chamber. Vacuum chamber 18 is an open area of attic space milled above the vacuum ports in vacuum head 12 where the airflow is maintained. As shown, the vacuum chamber extends substantially the full length and width of the vacuum head 12 at the upper portion of the head, and has a volume greater than either of front and rear vacuum ports.

Unlike prior art, vacuum chamber 18 allows for constant airflow distributed evenly through the front and rear vacuum ports. This creates a dynamic lift and an inverse relationship between lift and airflow. This coupled with the glides helps to increase the airflow for smoother operation and faster dry times.

Figure 2:
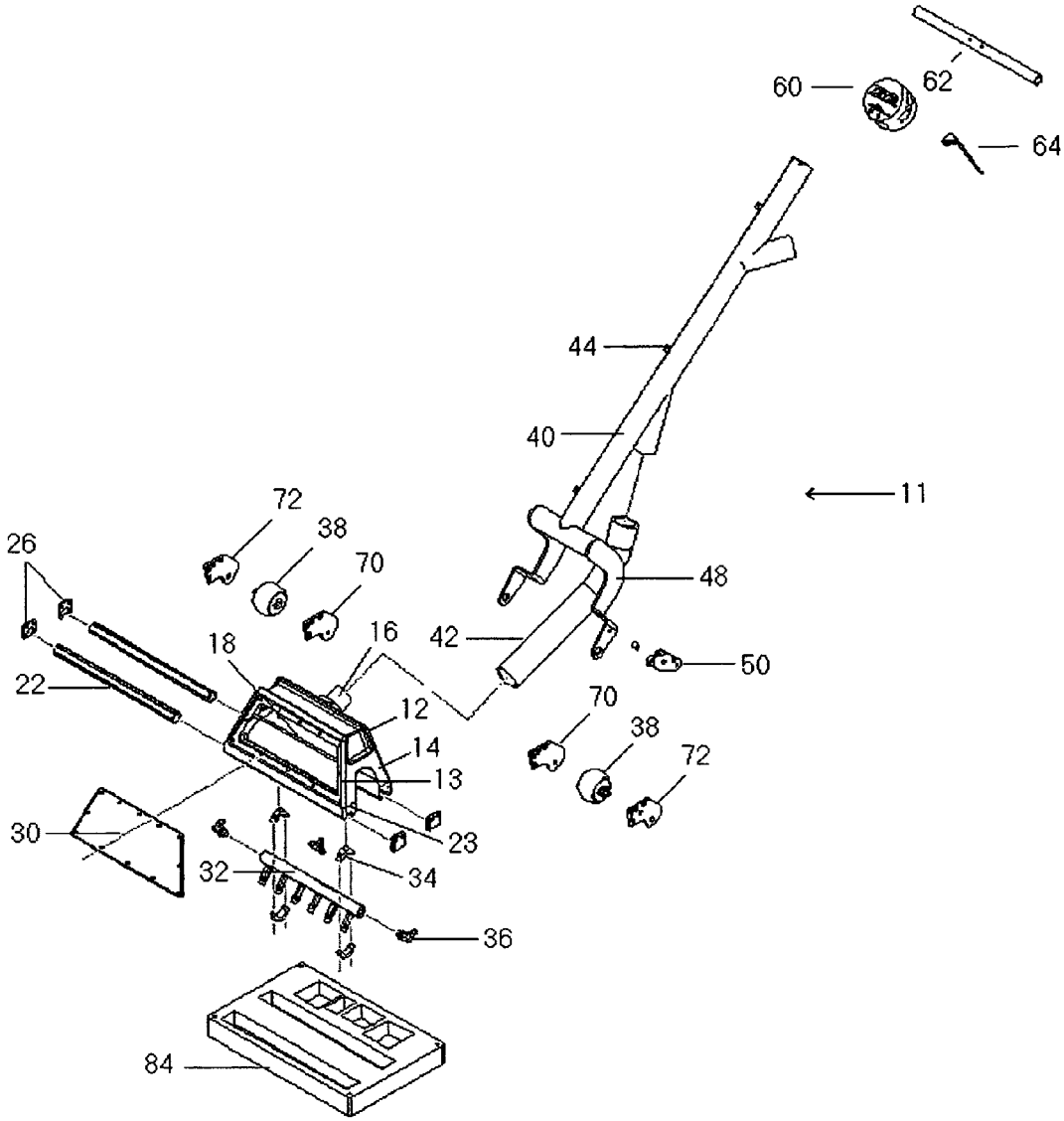
FIG. 2 is an exploded view of the device of FIG. 1.

Referring to FIGS. 1 and 2. Waste water moves through vacuum chamber 18 into outlet vacuum flange 16. Outlet vacuum flange 16 is coupled to liquid passageway 66 utilizing a two inch flexible vacuum hose 42. Liquid passageway 66 is connected to a flexible vacuum hose where waste water is extracted into the cleaning system. Referring to FIG. 2. Setup tray 84 houses sections for replacement parts, tools, and is used to adjust the wheels and as a storage and shipping mount for the apparatus.

Referring now to FIGS. 7-10, a second exemplary embodiment of the present invention will now be described. In these drawings only a vacuum head, including an adjustable wheel assembly, glides, etc. is depicted, but such vacuum head would be coupled to a handle such as the handle 40 of the first embodiment during use. Like parts are indicated using the same reference numbers as in the first embodiment.

The apparatus according to the second embodiment also includes a single vacuum head 112 with a single large vacuum chamber in the upper portion thereof and two vacuum inlet ports extending downwardly from the vacuum chamber parallel to one another. These inlet ports are positioned so that both ports penetrate the carpet fibers at an even depth at all times during operation. This unique feature allows for balanced airflow in the vacuum head due to the operator having no control of lifting the front or back ports off the ground due to the handle having a non-fixed position during operation. The open air space of the vacuum chamber in the vacuum head creates a dynamic lift and an inverse relationship between lift and airflow. This coupled with the glides greatly increases airflow for smoother operation and faster dry times.

As with to the first embodiment as described above, the dual port cleaning and extracting apparatus according to the second exemplary embodiment of the present invention is preferably coupled to a truck mounted cleaning machine using two inch vacuum hose or a similar flexible conduit and ¼ inch or similar high pressure/high temperature solution line. The dual port cleaning and extracting apparatus includes a vacuum head 112 which, again, would be coupled to a handle arm such as the arm 40 in the first embodiment.

According to primary distinct aspects of the second embodiment: the vacuum head 112 is formed with a main lower body 121 and an upper lid 127 removably attached to the main lower body; removable weights 137 are provided which can be secured on top of the lid 127 such that the overall weight of the apparatus can be better adapted to different types of carpeting; an adjustable wheeled assembly is modified such that it is easier to adjust the height of the wheels relative to the vacuum head 112, such that the wheel assembly can be easily, fully separated from the vacuum head 112 and attached to a different head, and such that the wheel assembly is simplified in construction; the structure of a pivoting handle is simplified, including a magnetic latch mechanism; and retainers for securing the glides in the vacuum head are formed larger such that a single retainer is used at opposite sides of the vacuum head to secure the ends of both glides, and to fully cover the gap between the two vacuum inlet ports such that an enclosed space is defined between the vacuum inlet ports, the lower surface of the vacuum head, the glide retainers, and the carpet being cleaned.

The lower body portion 121 of the vacuum head may be formed from a single block of aluminum using a machining process known as billet, but could be formed of other materials such as cast aluminum, molded plastic, etc. The upper lid portion 127 can be formed of metal, plastic and or other appropriate materials, and may be fastened to the lower body portion 121 via screws or other appropriate fastener(s). The upper lid portion 127 includes an outlet connection port 101 for being coupled to the vacuum hose, which port 101 may be integrally molded with the upper lid portion. As the waste liquid is being sucked from the carpet, it is drawn into the vacuum inlet ports of the lower body portion 121, through the outlet connection port 101, and into the vacuum hose and then stored in the truck mounted cleaning machine until it can be disposed of. The upper lid portion 127 may have a substantially flat upper surface. The substantially flat profile of the upper lid portion 127 desirably allows the apparatus to be smaller in the vertical direction (closer to the ground), thereby allowing it to fit in smaller/tighter spaces, e.g., under furniture and the like. Further, by manufacturing the vacuum head 112 in separate portions instead of as a single part, it can be more easily and economically manufactured.

Further still, at times, even with an optimum height of the vacuum head, to get a high-quality vacuum seal between the carpet and the vacuum head. For example, if the carpet is not tightly woven, it is hard to get a good vacuum seal without requiring the operator manually push down on the vacuum head. As such, in the present exemplary embodiment, one or more weight(s) 137 may be selectively secured to the top of the upper lid portion 127 for achieving an optimum weight for the head, while eliminating any need for an operator to push downwardlu on the head during a cleaning operation. Screw (s) or other fastener(s) may be used to fasten the weights 137, the upper lid portion 127 and the lower body portion 121.

Also depicted is a solution inlet fitting 113 which may be secured to the vacuum head via a threaded coupling or the like, and communicates with a solution manifold (not shown but corresponding to the manifold of the first embodiment) connected to the vacuum head for discharging water or a cleaning solution. Rather than using a solution manifold, the solution inlet fitting 113 may communicate directly with one or more jets connected to the vacuum head for discharging water or a cleaning solution.

The glides 24 may be the same as in the first embodiment and, again, may be sealably, slidably fitted into the ends of the vacuum inlet ports of the vacuum head via male/female channels and secured in place by glide retainers 126. Again, the combination of the vacuum head with the two vacuum ports and the glides fitted in and projecting from the ports allows for maximum airflow, stability of vacuum head 112, and reduced friction on the cleaning surface. Similar to the first embodiment discussed above, the vacuum head 112 is designed the rounded design of the glides 24. The glides 24 may be formed in an elongate shape. Several female glide channels 22 are provided in the glides 24 wherein the female glide channels 22 are recessed into and extend substantially along the full length of the glides 24, while the elongate opening formed through the glide opens at top and bottom surfaces of the glide, each spaced approximately 90° from the two female glide channels 22 provided on opposite sides of each glide 24.

The vacuum head 112 is provided with several recessed portions in the bottom face thereof. These recessed portions are rounded in shape such that the guides 24 can fit therein. On both sides of the recessed portion at a position level with the bottom face of the vacuum head 112 are male glide channels 23. The male glide channels 23 fit inside of the female glide channels 22 of the glides 24 such that the glides can be easily slid into and out of the channels 23 and form a secure seal with the vacuum head. In order to insert the guides 24 into the vacuum head 112, the female glide channels 22 of the glide are matched up with male glide channels 23 of the vacuum head 112 and the glide is then slid along the male glide channels 23 until it is in place. When the glides 24 are inserted properly into the vacuum head 112, a portion of the glides 24 protrudes from the lower surface of the vacuum head 112 for engaging the carpeting or other surface being cleaned. By designing the glide 24 with two female glide channels 22, one located on each side of the glide 24, the glide 24 becomes reversible relative to vacuum head 112 such that opposite sides of the glide may be selectively positioned to project from the lower face of the vacuum head 112, thus doubling the life of the glide. Further, the support bridges 28 are recessed far enough into glides 24 to ensure that as the glides 24 wear out, the support bridges 28 will not come into contact with the carpet thereby breaking up the opening into separate chambers. By recessing the support bridges 28 so far into the glides 24, bridge lines, which are undesirable to most customers, are not formed in the carpet being cleaned.

Figure 7:
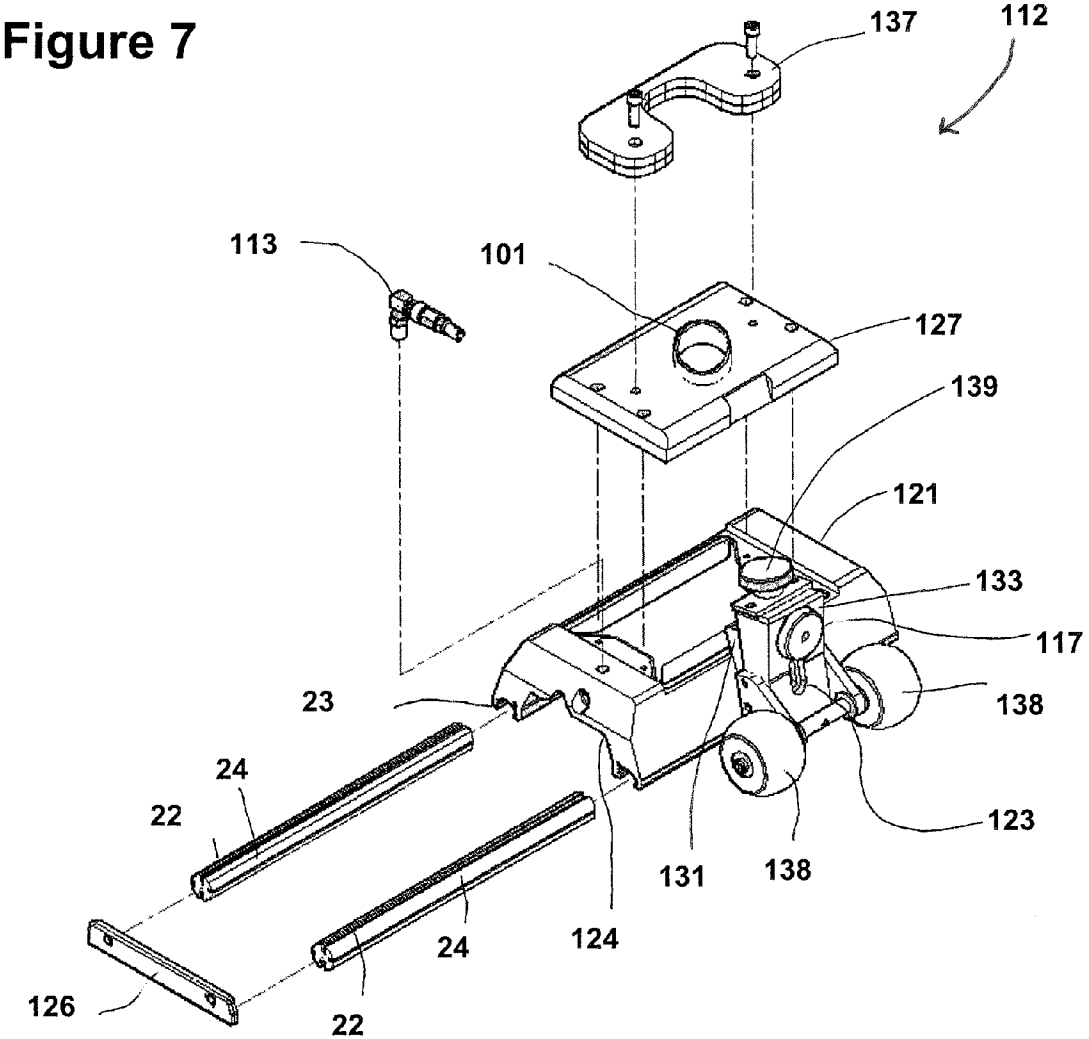
FIG. 7 is an exploded rear perspective view of a vacuum head with wheel and handle latching assemblies according to a second exemplary embodiment of the invention.
Figure 8:
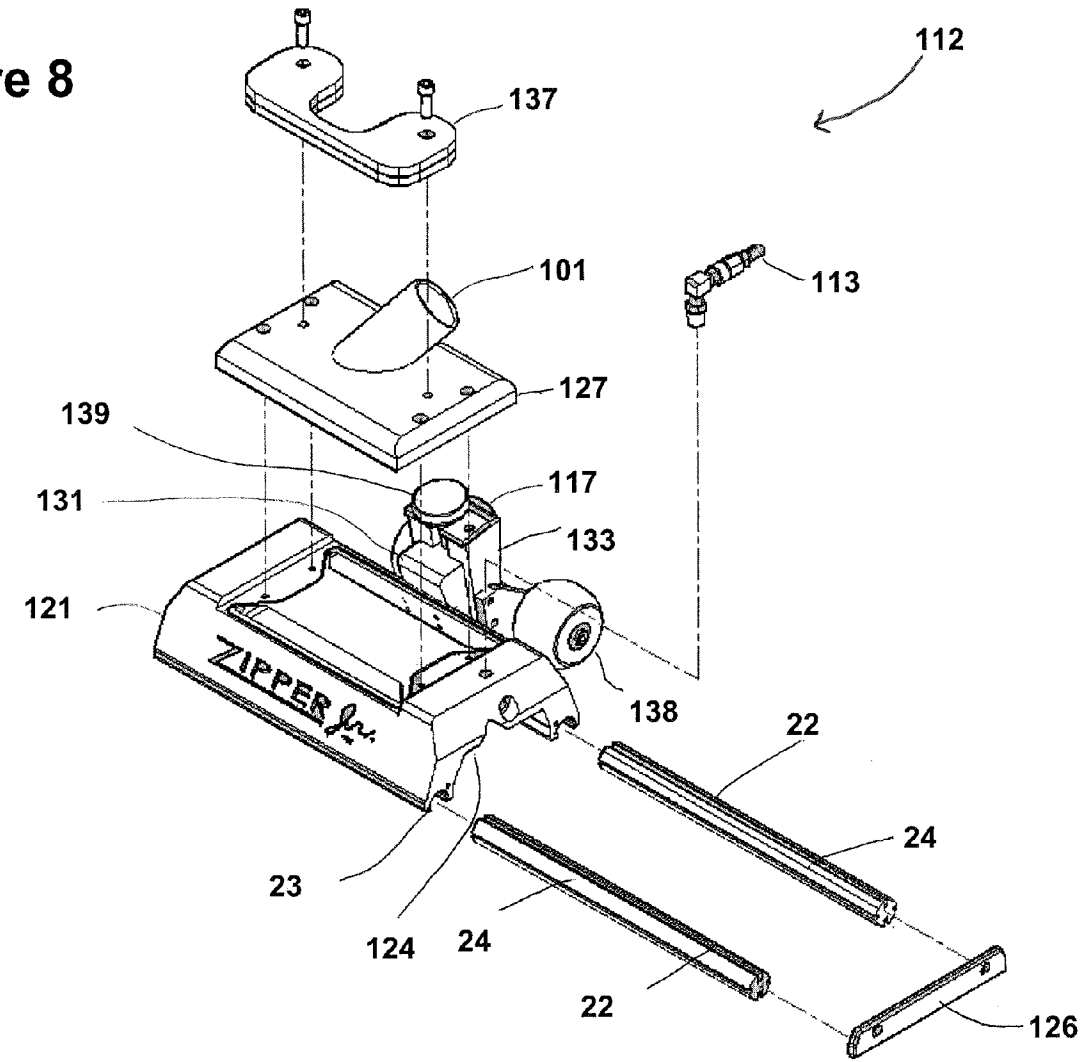
FIG. 8 is an exploded front perspective view of the vacuum head and associated assemblies of FIG. 7.
Figure 9:
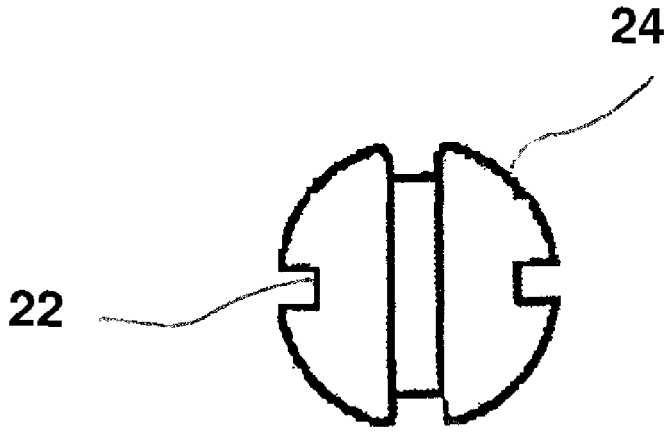
FIG. 9 is an enlarged cross-sectional view of one of the glides facing towards one of the recessed support bridges therein.
Figure 10:
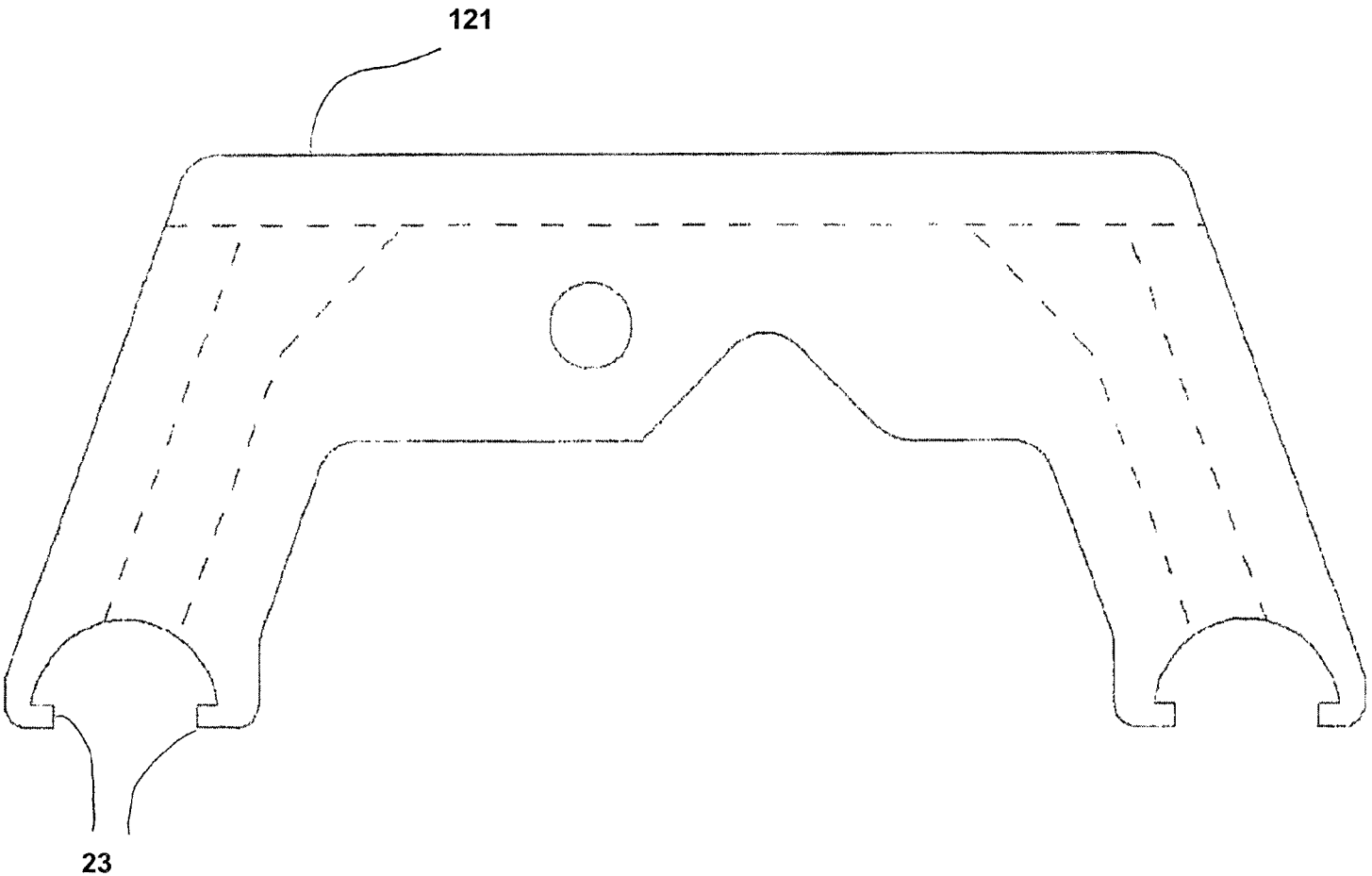
FIG. 10 is an enlarged side end view of the vacuum head.

As discussed above, these glides 24 may be held in place, preventing lateral movement, using four glide retainers, which also serve as a bumper to prevent scratching of walls, baseboards, and other objects. However, the glides 24 may instead be held into place using only a single glide retainer 126 on each side of the vacuum head 112 such as depicted in FIGS. 7, 8. These glide retainers 126 may span the entire width of the lower surface of the vacuum head 112 and each placed on opposite sides of the vacuum head 112, thereby holding both guides in place. While the glide retainers 126 shown herein leave side openings 124 of the vacuum head 112 only partially enclosed, the glide retainers 126 may be formed such that they fully cover the side openings 124 of the vacuum head 112, thereby fully enclosing a space below the vacuum head. By making the glide retainers 126 larger so as to fully enclose the side openings 124 of the vacuum head 112, this prevents more humidity from being released into the air of the room wherein the carpet is being cleaned.

To maintain the stability of vacuum head 112, an adjustable wheeled assembly including wheels 138 (preferably convex wheels) may be attached to the rear surface of the vacuum head 12. Preferably, the wheels 138 are provided such that two wheels 138 are fixed together using a single short axle. The wheels 138 are designed such that the entire cleaning and extracting apparatus can be easily moved laterally across the surface being cleaned.

As depicted, the adjustable wheeled support mechanism may include a male adjustment block 131 attached to the rear/back side of the vacuum head 112 and a mating female adjustment block 133 provided with wheels 138 attached to the bottom portion thereof. The female adjustment block 133 is designed such that it will fit securely together with the bottom portion of the male adjustment block 131 and may be secured thereto with screw(s) or other appropriate fastener(s) which extend through an elongate opening 123 to engage the male adjustment block. Additionally, the female adjustment block 133 may be provided with and an adjustment knob 139 which may be manipulated using one hand 6 to easily and efficiently adjust the height of the wheels 138 relative to the bottom surface of the vacuum head 112 when the screw(s) or other appropriate fastener(s) are loosened. When the two blocks are at an appropriate alignment for a given carpeting or other surface, the screw(s) or other appropriate fastener(s) are tightened to secure the wheels at an appropriate level. Further still, by this design, it is possible to easily completely separate the female adjustment block 133 along with the wheels 138 from the vacuum head including the male block 131, and then attach the wheels to a different vacuum head. This may be desirable if a vacuum head becomes damaged, if a different length/size vacuum is desired, etc.

When using a device to clean a carpet, it is important that the vacuum head of the device be at an optimum level with the carpet being cleaned. For example, if the vacuum head is just slightly too high off the carpet, the vacuum which is created is not strong enough to efficiently pull the dirt/grime along with the waste water from the carpet. Thus, the carpets will not be completely clean and further since a larger amount of the waste water was left in the carpet, the carpet will take longer to dry. On the other hand, if the vacuum head is positioned such that it is down too far into the carpet as it is being cleaned, too strong of a vacuum is created, and the carpet gets in the way of the movement of the apparatus, thereby making it very difficult on the user of the apparatus to maneuver the vacuum head. As such, being able to adjust the height of the vacuum head with respect to the wheels quickly and efficiently allows the operator to easily achieve an optimum height of the vacuum head.

Although not shown, a pivoting handle including a solution discharge valve, connections for solution supply hose and a vacuum discharge hose such as in the first embodiment will be provided together with the vacuum head according to the second embodiment. The handle is structurally simplified in comparison to that of the first embodiment relative to the connection with the vacuum head and wheeled support assembly and relative to its latching mechanism. Particularly, the handle may be formed with a substantially straight main shaft and a T-shaped handle, wherein the lower end of the main shaft may be pivotally connected to the wheeled support mechanism at a position between the two wheels such that the handle pivots about the axle of the wheels, while the handle latching mechanism according to the second embodiment may simply include a magnet 117 which may be attached to the back/rear surface of the female adjustment block 133 and/or to a portion of the handle facing the female adjustment block 133. The magnet 117 is strong enough to normally hold the handle in a non-use position adjacent to the female adjustment block 133, but by pulling downwardly on the handle with a moderate force the attraction of the magnet can be overcome to separate the handle into an operative position where it an freely pivot about the axle.

The apparatus according to the second embodiment achieves all of the advantages achieved by the first embodiment, while the apparatus of the second embodiment is additionally more convenient to use and structurally simplified in comparison to the first embodiment.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. An apparatus for enhancing vacuum removal of liquid from fabric comprising:

a base member having an elongate aperture forming an extraction inlet;

an elongate glide having an elongate opening defined there through, and shaped to be sealingly fitted in said aperture such that a lower surface of the glide including one end of the elongate opening projects below a lower surface of the base member; and a retainer for securing the elongate glide in the elongate aperture; wherein one of said elongate glide and said elongate aperture has female support channels formed therein, and the other of said elongate glide and said elongate aperture has male support channels formed therein which slidingly engage the female support channels for permitting the elongate glide to be sealingly fitted the elongate aperture;

the retainer is sealingly secured to one side of the base member for preventing the elongate glide from sliding relative the elongate aperture and such that liquid can be drawn into the base member substantially only through the elongate opening defined through the glide; and said glide is reversible relative to said elongate aperture such that opposite sides of the glide may be selectively positioned to project below the lower face of the base member.

2. The apparatus of claim 1 wherein said glide is formed of plastic.

3. An apparatus for enhancing vacuum removal of liquid from fabric comprising:

a base member having an elongate aperture forming an extraction inlet;

an elongate glide having an elongate opening defined there through, and shaped to be sealingly fitted in said aperture such that a lower surface of the glide including one end of the elongate opening projects below a lower surface of the base member; and a retainer for securing the elongate glide in the elongate aperture; wherein one of said elongate glide and said elongate aperture has female support channels formed therein, and the other of said elongate glide and said elongate aperture has male support channels formed therein which slidingly engage the female support channels for permitting the elongate glide to be sealingly fitted the elongate aperture;

the retainer is sealingly secured to one side of the base member for preventing the elongate glide from sliding relative the elongate aperture and such that liquid can be drawn into the base member substantially only through the elongate opening defined through the glide; and wherein said glide includes at least one support bridge formed within the elongate opening for separating the elongate opening into multiple vacuum chambers, said at least one support bridge is recessed within the glide spaced away from an outer surface of the glide.

4. An apparatus for enhancing vacuum removal of liquid from fabric comprising:

a base member having an elongate aperture forming an extraction inlet;

an elongate glide having an elongate opening defined there through, and shaped to be sealingly fitted in said aperture such that a lower surface of the glide including one end of the elongate opening projects below a lower surface of the base member; and a retainer for securing the elongate glide in the elongate aperture; wherein one of said elongate glide and said elongate aperture has female support channels formed therein, and the other of said elongate glide and said elongate aperture has male support channels formed therein which slidingly engage the female support channels for permitting the elongate glide to be sealingly fitted the elongate aperture;

the retainer is sealingly secured to one side of the base member for preventing the elongate glide from sliding relative the elongate aperture and such that liquid can be drawn into the base member substantially only through the elongate opening defined through the glide; and wherein said glide is substantially circular in cross section.

* * * * *